US007071930B2

(12) United States Patent
Kondo et al.

(10) Patent No.: US 7,071,930 B2
(45) Date of Patent: Jul. 4, 2006

(54) ACTIVE MATRIX DISPLAY DEVICE, VIDEO SIGNAL PROCESSING DEVICE, METHOD OF DRIVING THE ACTIVE MATRIX DISPLAY DEVICE, METHOD OF PROCESSING SIGNAL, COMPUTER PROGRAM EXECUTED FOR DRIVING THE ACTIVE MATRIX DISPLAY DEVICE, AND STORAGE MEDIUM STORING THE COMPUTER PROGRAM

(75) Inventors: Tetsujiro Kondo, Tokyo (JP); Hideo Nakaya, Kanagawa (JP); Tsutomu Ichikawa, Kanagawa (JP); Takao Inoue, Kanagawa (JP)

(73) Assignee: Sony Corporation, Tokyo (JP)

( * ) Notice: Subject to any disclaimer, the term of this patent is extended or adjusted under 35 U.S.C. 154(b) by 406 days.

(21) Appl. No.: 10/603,307

(22) Filed: Jun. 25, 2003

(65) Prior Publication Data

US 2004/0056854 A1 Mar. 25, 2004

(30) Foreign Application Priority Data

Jun. 27, 2002 (JP) ..... 2002-187998

(51) Int. Cl.
*G09G 5/00* (2006.01)

(52) U.S. Cl. ..... 345/204; 345/211; 345/212; 345/213; 345/215

(58) Field of Classification Search ..... 345/87–104, 345/204–215
See application file for complete search history.

(56) References Cited

U.S. PATENT DOCUMENTS 5,280,280 A * 1/1994 Hotto ..... 345/94
5,444,457 A * 8/1995 Hotto ..... 345/94
5,831,588 A * 11/1998 Hotto ..... 345/100

OTHER PUBLICATIONS

Patent Abstracts of Japan 2000-284755, Oct. 13, 2000.

* cited by examiner

*Primary Examiner*—Vijay Shankar
(74) *Attorney, Agent, or Firm*—Frommer Lawrence & Haug LLP; William S. Frommer; Thomas F. Presson

(57) ABSTRACT

An active matrix display device includes a pixel array unit having pixels arranged in a matrix pattern, a scanning circuit which sequentially selects pixels in unit of rows, and a signal circuit which receives a video signal containing serial dot data corresponding to each pixel and which writes the dot data into a selected pixel. The signal circuit receives a video signal which includes dot data corresponding to pixels to be rewritten but does not include dot data corresponding to pixels not to be rewritten and which includes skip data defining a skip amount. The signal circuit sequentially processes the dot data and skip data so as to write the corresponding dot data into pixels to be rewritten by skipping pixels not to be rewritten based on the skip data.

21 Claims, 9 Drawing Sheets

ACTIVE MATRIX DISPLAY DEVICE, VIDEO SIGNAL PROCESSING DEVICE, METHOD OF DRIVING THE ACTIVE MATRIX DISPLAY DEVICE, METHOD OF PROCESSING SIGNAL, COMPUTER PROGRAM EXECUTED FOR DRIVING THE ACTIVE MATRIX DISPLAY DEVICE, AND STORAGE MEDIUM STORING THE COMPUTER PROGRAM

BACKGROUND OF THE INVENTION

1. Field of the Invention

The present invention relates to an active matrix display device and a video-signal processing device. More specifically, the present invention relates to an active matrix display device using a partial writing method or differential writing method, in which video data is written into pixels to be changed in each frame in order to display a moving picture. Also, the present invention relates to a video-signal processing device for generating/processing a video signal for realizing partial writing.

2. Description of the Related Art

Active matrix display devices, which are flat, are being developed as next-generation displays replacing CRTs. FIG. 1 is a schematic block diagram showing a general configuration of an active matrix display device of a related art. As shown in FIG. 1, the display device includes a pixel array unit 1 and a peripheral circuit unit 23 for driving the pixel array unit 1. The pixel array unit 1 and the peripheral circuit unit 23 may be formed on the same substrate, or may be formed separately. The pixel array unit 1 includes rows of gate lines X, columns of signal lines Y, and pixels provided at the intersections thereof, the pixels being arranged in a matrix pattern. Each pixel is driven by a switching element such as a TFT. The gate electrode of each TFT is connected to a corresponding gate line X, the source electrode thereof is connected to a corresponding signal line Y, and the drain electrode thereof is connected to a corresponding pixel.

The peripheral circuit unit 23 includes a vertical shift register 2X, a horizontal shift register 3Y, and a sampling switch group 31. The vertical shift register 2X sequentially selects pixels in units of rows through each gate line X. The sampling switch group 31 includes a plurality of sampling switches provided between a video line VL and the signal lines Y. A video signal is supplied to the video line VL from an external signal source. The video signal includes dot data corresponding to each pixel and has a time-series one-dimensional structure. The horizontal shift register 3Y sequentially opens/closes the sampling switches so as to sample the video signal from the video line VL to each signal line Y. Accordingly, corresponding dot data is written into pixels of a selected line on a dot-sequential basis.

As described above, in the active matrix display device of the related art, dot-sequential driving method, in which time-series one-dimensional video signal is written into pixels on a dot-sequential basis, is generally used. In some cases, line-sequential driving method may be used, in which a latch circuit of one line is provided between the sampling switch group 31 and the signal lines Y, and a video signal is written into pixels in selected rows on a line-sequential basis. In the active matrix display device of the related art, a time-series one-dimensional video input method is used as in CRTs. In this method, all pixels are dot-sequentially updated in each frame. Accordingly, a sampling clock frequency increases as the number of pixels increases.

The active matrix display device has a so-called hold characteristic, in which the luminance of pixels is maintained to the next frame. The hold characteristic causes blur in moving pictures. However, a method of using this characteristic positively and updating only interframe difference so as to display moving pictures has been proposed. This method is disclosed, for example, in Japanese Unexamined Patent Application Publication No. 2000-284755. Hereinafter, the principle of a partial rewriting method, in which only interframe difference is updated, will be briefly described with reference to FIGS. 2A to 2C. FIGS. 2A to 2C illustrate display patterns in which frames are changed from n-th frame (nF) to n+1-th frame (n+1F). In the display, a circular object is a moving object and a rectangular object is a stationary object. In FIG. 2A, a camera is fixed and the position of the moving object is changed from nF to n+1F. In this way, when a moving object exists at only a part of the display, an interframe difference component is minimized with respect to the entire display. In this case, by updating only the interframe difference, a moving picture can be displayed. In FIG. 2B, the camera is moving so as to follow a moving object. In this case, the position of stationary objects in the display relatively changes in frames. In FIG. 2C, the camera is moving independently of the motion of a moving object. In this case, the position of both of the moving object and stationary objects changes in frames. In FIGS. 2B and 2C, since the camera moves, an interframe difference component occupies the entire display in principle. However, a spatial redundancy actually exists in the display, and the ratio of difference component is reduced accordingly. Therefore, in any pattern of FIGS. 2A to 2C, a frame can be rewritten by changing only interframe difference, so that entire rewrite can be performed in a cycle of several frames to several tens of frames. By combining partial rewrite and entire rewrite, each frame can be rewritten by simply changing differential pixels. If the number of differential pixels is 10% with respect to all the pixels, a sampling clock frequency (dot clock) can be reduced to 1/10.

FIG. 3 is a block diagram showing an example of an active matrix display device in which partial writing can be performed. In FIG. 3, parts corresponding to those of the preceding example shown in FIG. 1 are denoted by the same reference numerals for clear understanding. In the display device shown in FIG. 3, a horizontal addressing circuit 3A is adopted instead of the horizontal shift register 3Y, so as to perform partial writing by a dot-sequential driving method. In the dot-sequential driving method in FIG. 1, the horizontal shift register 3Y sequentially controls open/close of the sampling switches. On the other hand, the horizontal addressing circuit 3A in FIG. 3 opens/closes only a necessary sampling switch, so that random scanning is performed. An address signal as well as a video signal is supplied to the horizontal addressing circuit 3A. The address signal specifies the position of a pixel to be rewritten. The horizontal addressing circuit 3A randomly accesses a sampling switch based on the address signal, so that dot data is written into a corresponding pixel by random access. By performing partial rewrite shown in FIG. 3, transfer rate of dot data can be advantageously increased. If the video format is 60 frames/second, 720×480 pixels, and dot-sequential scanning is adopted, then the transfer rate of dot data (dot clock) is about 25 MHz. When time-series one-dimensional input is performed as in CRT, a shift register operating in the vertical direction at about 30 KHz is required in the active matrix display device. Also, in the horizontal direction, a horizontal shift register operating at about 25 MHz is required. This is the same for still pictures and moving pictures. Herein, if the ratio of differential pixels is 10%, dot clock can be reduced to 1/10. By using this method, data transfer rate can be effectively increased, and efficient display can be performed by combining with a coding signal in a video input side.

However, since differential video is displayed, when random addressing as a memory is adopted, both of address and video must be input to a panel. Accordingly, the number of external input terminals for the display device increases. Also, in the display device side, an address decoder or the like must be provided in the horizontal addressing circuit, and thus the peripheral circuit is complicated. Therefore, the size of the peripheral circuit of the display device increases disadvantageously. Further, in random addressing, the access frequency is a dot frequency (several tens of MHz) in both horizontal and vertical directions. Therefore, reliability of an addressing operation is reduced and a propagation delay and noise caused by the length of wiring in the panel become significant. Accordingly, in a method of rewriting only interframe difference, it is not always adequate to perform random addressing to pixels to be rewritten, which should be solved.

FIG. 4 schematically shows random addressing. In FIG. 4, pixels are represented by dots. Black dots are pixels to be rewritten and white dots are pixels which need not be rewritten. The position of each pixel is defined by an absolute address, so that a pixel to be rewritten is specified by the absolute distance/direction from a reference point P. The horizontal addressing circuit 3A randomly scans the sampling switches based on the absolute address information, so as to write dot data into a desired pixel. For example, the black dots are specified by the absolute addresses: (X1, Y2), (X2, Y4), and (X3, Y6), respectively. In random addressing, however, when the next pixel is turned on, the distance and direction from the previous pixel is random. In an extreme case, for example, when scanning is performed from the upper-left to the lower-right, it is difficult for an active matrix display device having some physical areas to perform the scanning at a rate of several MHz of a dot clock, although it may be realized by a memory with a high integration.

SUMMARY OF THE INVENTION

The present invention has been made in view of the above-described problems of the related art, and it is an object of the present invention to provide an active matrix display device for performing partial writing without increasing complexity of a peripheral circuit. In order to achieve this object, according to an aspect of the present invention, an active matrix display device includes a panel on which pixels are arranged in a matrix pattern; a scanning circuit for sequentially selecting pixels on the panel in units of rows; and a signal circuit which sequentially receives pieces of video data, each including a status part indicating need/no need for rewriting a pixel and a main data part including video data to be written into the pixel, and which writes corresponding video data into pixels which have been determined to be rewritten based on the status part among the selected pixels, while skipping the other pixels.

According to another aspect of the present invention, an active matrix display device includes a pixel array unit including pixels which are arranged in a matrix pattern; a scanning circuit for sequentially selecting pixels in units of rows; and a signal circuit which receives a video signal including serial dot data corresponding to each pixel and which writes the dot data into the selected pixels. The signal circuit receives a video signal which includes dot data corresponding to pixels to be rewritten but does not include dot data corresponding to pixels not to be rewritten and which includes skip data defining a skip amount. Also, the signal circuit sequentially processes the dot data and the skip data so as to write corresponding dot data into pixels to be rewritten while skipping pixels not to be rewritten in accordance with the skip amount. Preferably, the signal circuit receives a video signal including dot data and skip data, both data having the same format including a status part and a data part, and distinguishes the dot data from the skip data based on the status part. Also, the signal circuit obtains a skip amount indicating the number of pixels to be skipped from the data part of the skip data, extracts luminance information of a pixel to be rewritten from the data part of the dot data. When the number of pixels to be skipped exceeds a maximum number that can be defined by a piece of skip data, the signal circuit processes skip data which is continuously input until the number reaches the target skip amount so as to skip pixels. Also, the signal circuit receives a video signal including row skip data which defines a skip amount in units of rows, and performs writing of dot data while skipping pixels in units of rows based on the row skip data. Further, the signal circuit mixes, at a predetermined ratio, frames to which a partial rewrite operation for partially rewriting the pixels arranged in a matrix pattern is performed by processing the video signal including the dot data and the skip data and frames to which an entire rewrite operation for entirely rewriting the pixels arranged in a matrix pattern is performed by processing the video signal including the dot data.

According to another aspect of the present invention, a signal processing device includes a differential detecting unit for detecting and outputting a differential value between the video data of a current frame corresponding to a target pixel and the video data of the previous frame; a determining unit for determining whether or not the differential value output from the differential detecting unit is equal to or exceeds a predetermined threshold value; and an output-data generating unit which generates output data based on status data indicating that a pixel is to be rewritten and the video data of the current frame when the determining unit determines that the differential value is equal to or exceeds the predetermined threshold value and which generates output data based on status data indicating that a pixel is not to be rewritten and a skip amount defining the number of pixels to be skipped when the differential value is less than the predetermined threshold value.

The active matrix display device according to the present invention need not receive address information and a video signal from individual systems. Also, the active matrix display device of the present invention can perform partial rewrite based on a composite video signal including dot data and skip data. The composite video signal includes dot data corresponding to pixels to be rewritten but does not include dot data corresponding to pixels not to be rewritten, and includes skip data defining a skip amount. Serial video signals including dot data and skip data are sequentially processed, so that corresponding dot data is written into pixels to be rewritten by skipping pixels not to be rewritten based on the skip amount. In the present invention, a relative address, that is, the skip amount, is used instead of an absolute address in order to address a pixel to be rewritten. By sequentially synthesizing dot data and skip data so as to generate a composite video signal, absolute address information and a video signal need not be input through individual systems. Also, in the serial video signal, dot data and skip data have the same format, including a status part and a data part. The dot data is distinguished from the skip data based on the status part, and a skip amount (relative address) indicating the number of pixels to be skipped can be obtained from the data part of the skip data. By using this relative address, partial rewrite is realized by performing skip scanning.

DESCRIPTION OF THE PREFERRED EMBODIMENTS

Figure 1:
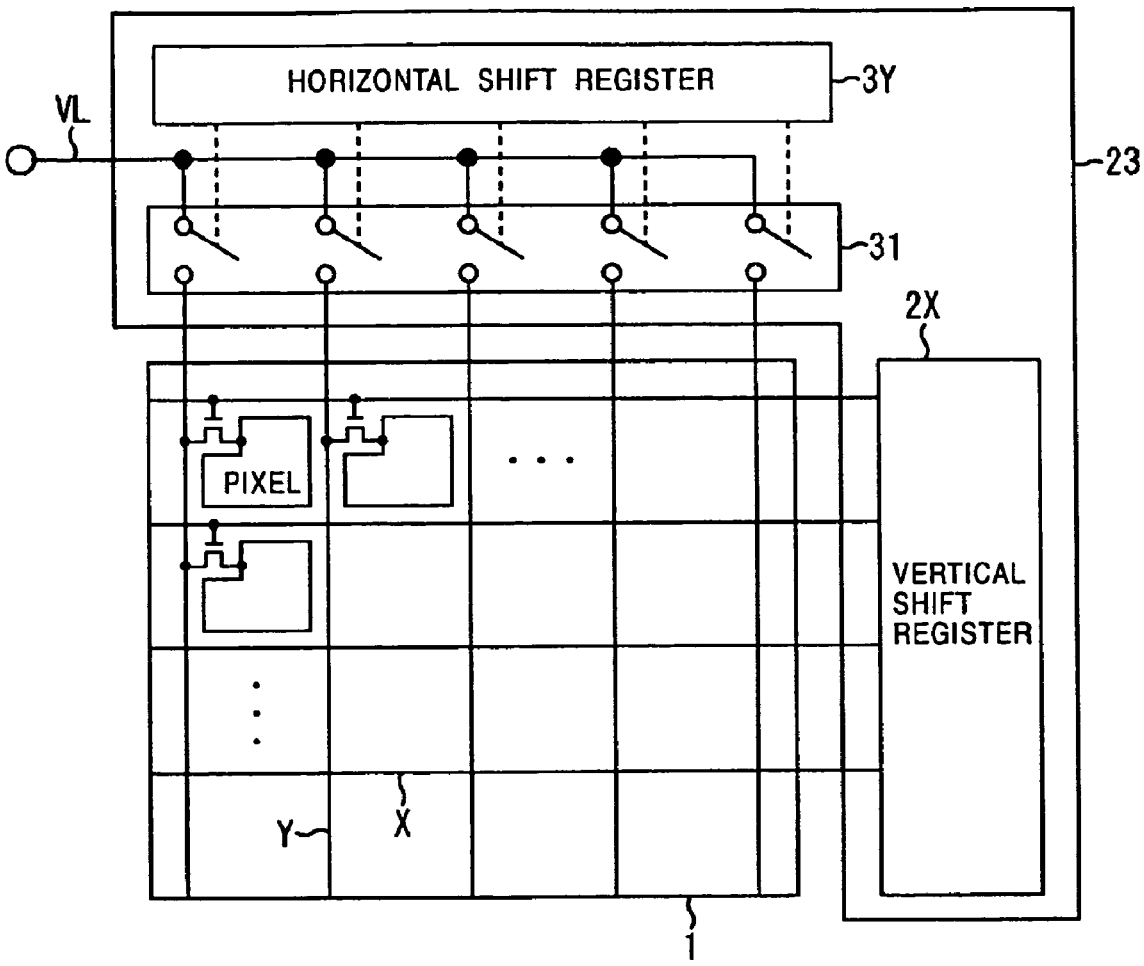
FIG. 1 PRIOR ART
FIG. 1 is a block diagram showing an active matrix display device of a related art.
Figure 2C:
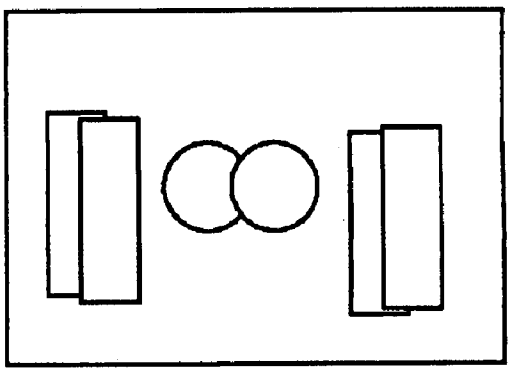
FIGS. 2A to 2C are schematic views showing the principle of a partial writing method.
Figure 2B:
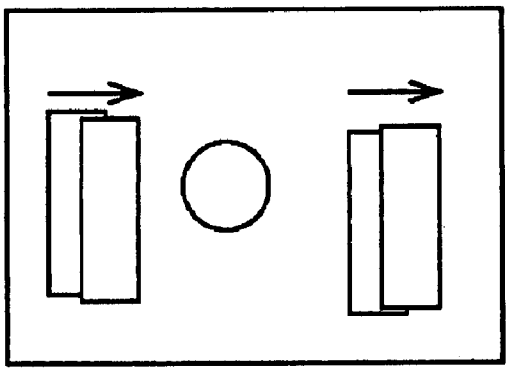
Figure 2A:
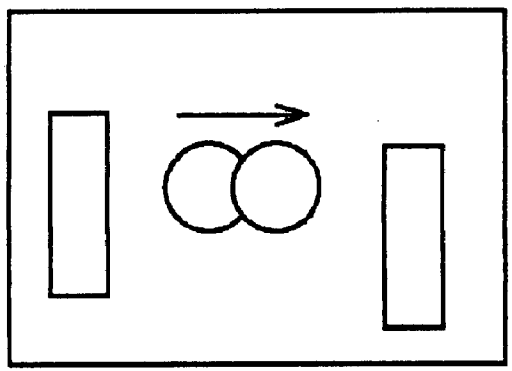
Figure 3:
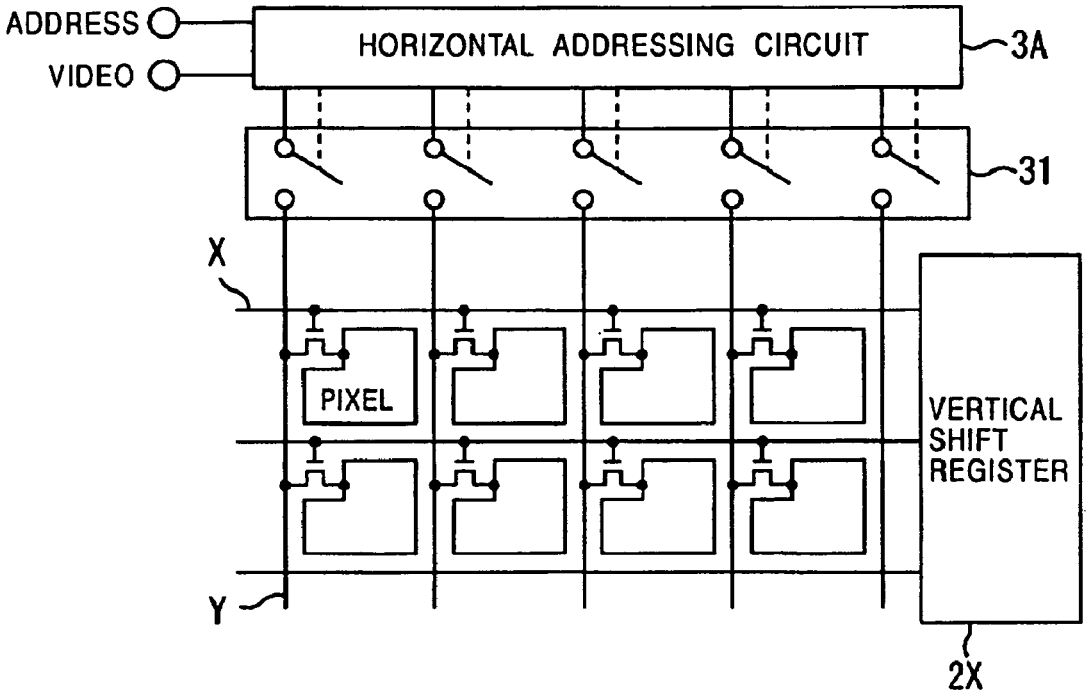
FIG. 3 is a block diagram showing a display device for performing the partial writing method of the related art.
Figure 4:
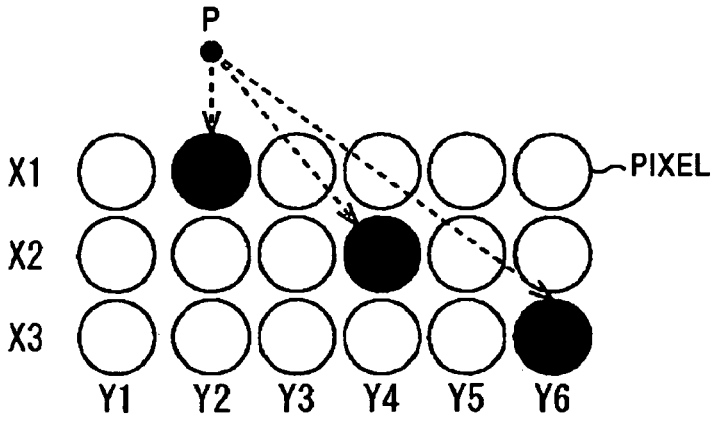
FIG. 4 PRIOR ART
FIG. 4 illustrates the operation of the display device shown in FIG. 3.
Figure 5A:
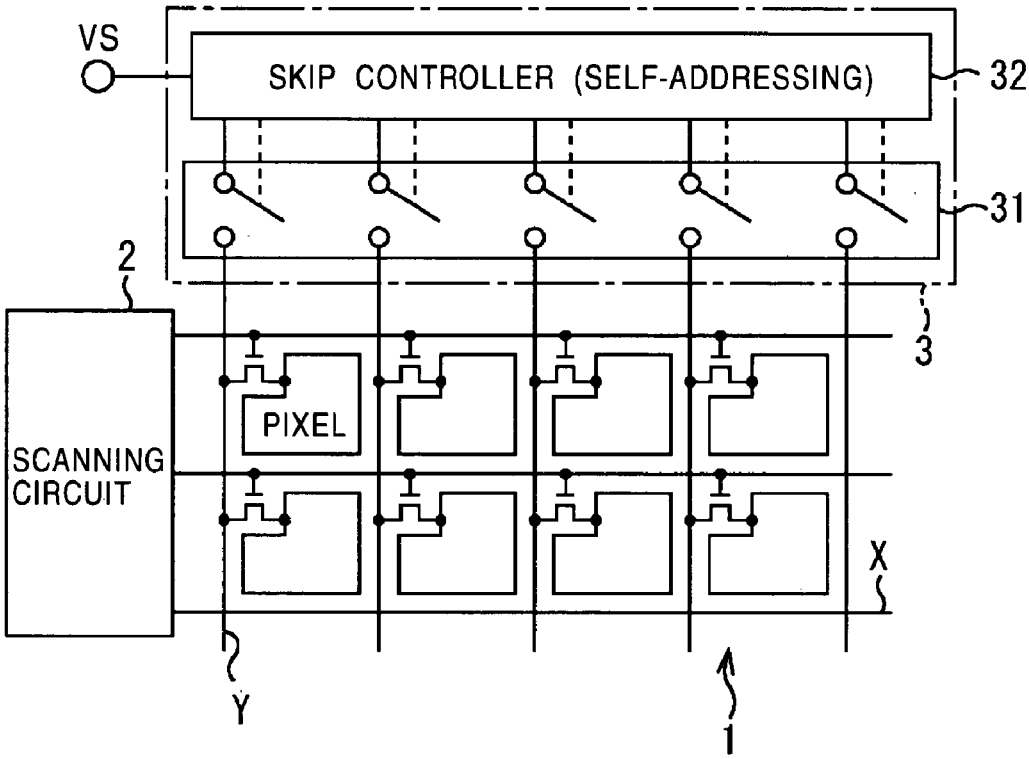
FIG. 5A shows the configuration of an active matrix display device according to the present invention.
Figure 5B:
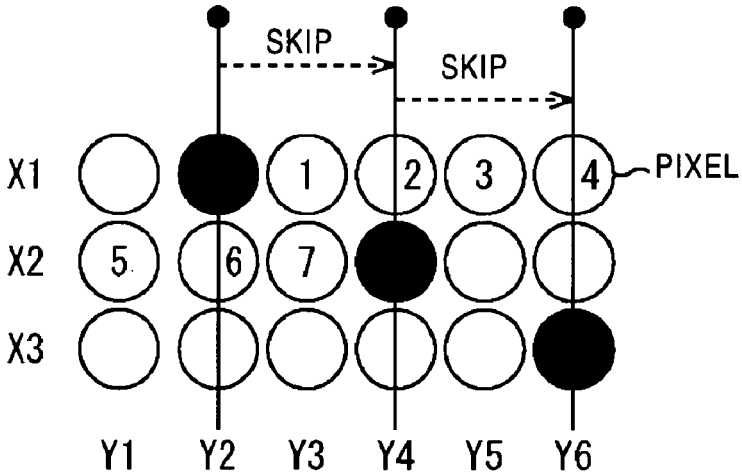
FIG. 5B illustrates the operation of the display device shown in FIG. 5A.

Hereinafter, an embodiment of the present invention will be described with reference to the drawings. FIGS. 5A and 5B are schematic views showing the configuration and operation of an active matrix display device according to the present invention. As shown in FIG. 5A, the active matrix display device includes a pixel array unit 1, a scanning circuit 2, and a signal circuit 3. The pixel array unit 1 includes rows of gate lines X, columns of signal lines Y, and pixels provided at the intersections thereof, the pixels being arranged in a matrix pattern. The pixel array unit 1 having such a configuration serves as a flat panel. Also, switching elements for driving the pixels, such as TFTs, are integrally formed on the panel. Liquid crystal cells, which are formed by sandwiching liquid crystal by pixel electrodes and opposed electrodes facing each other, can be used as the pixels.

The scanning circuit 2 is connected to the gate lines X and sequentially selects pixels in units of rows. The signal circuit 3 receives a video signal VS including serial dot data corresponding to each pixel, and writes the dot data into selected pixels. For this purpose, the signal circuit 3 includes a sampling switch group 31. The scanning circuit 2 and the signal circuit 3, which serve as peripheral circuits, may be incorporated into the panel provided with the pixel array unit 1. Alternatively, the panel may include only the pixel array unit 1, and the peripheral circuits may be provided on a separate substrate so as to be connected to the panel.

Further, the signal circuit 3 includes a skip controller 32, so that partial writing is realized by self-addressing. The skip controller 32 supplies a video signal to each sampling switch and controls open/close of the switches by a self-addressing method. Specifically, the skip controller 32 receives a video signal which includes dot data corresponding to pixels to be rewritten but does not include dot data corresponding to pixels not to be rewritten and which includes skip data defining a skip amount (the number of pixels to be skipped). The skip controller 32 sequentially processes the dot data and skip data, so as to write corresponding dot data into the pixels to be rewritten, while skipping pixels which need not be rewritten based on the skip data.

The video signal received by the skip controller 32 includes dot data and skip data, both data having the same format including a status part and a data part. The skip controller 32 distinguishes dot data from skip data based on the status part. Then, the skip controller 32 obtains a skip amount, that is, the number of pixels to be skipped, from the data part of the skip data, and also extracts luminance information of a pixel to be rewritten from the data part of the dot data. When the number of pixels to be skipped exceeds a maximum number that can be defined by one piece of skip data, the skip controller 32 processes skip data which is continuously input thereto until the skip amount reaches a target value, and then skipping of pixels is performed. Preferably, the skip controller 32 can receive a video signal including row skip data which defines a skip amount in units of rows. In this case, writing of dot data can be performed by skipping pixels in units of rows based on the row skip data. In the embodiment, the scanning circuit 2 and the signal circuit 3 can selectively perform a partial rewrite operation, in which a video signal including dot data and skip data is processed so as to partially rewrite pixels arranged in a matrix pattern, and an entire rewrite operation, in which a video signal including only dot data is processed so as to entirely rewrite pixels arranged in a matrix pattern. Also, in the embodiment, frames to which a partial rewrite operation is performed (differential frames) and frames to which an entire rewrite operation is performed (refresh frames) can be mixed at a predetermined ratio. For example, a partial rewrite operation is performed to every frame, and at the same time, an entire rewrite operation, instead of the partial rewrite operation, is performed at a cycle of several frames to several tens of frames.

FIG. 5B is a schematic view showing a skip scanning operation. In FIG. 5B, pixels are represented by circular dots, in which black dots are pixels to be rewritten and white dots are pixels not to be rewritten. Seven white dots, which need not be rewritten, exist between a first black dot and a second black dot. In the present invention, partial rewrite is realized by scanning pixels while skipping the white dots between the first and second black dots. The skip amount is defined by skip data. In a normal video signal, seven pieces of white dot data follow the first black dot data, and the second black dot data follows the white dot data. In the present invention, the seven pieces of white dot data between the two pieces of black dot data are replaced by skip data. The skip data indicates the skip amount between the first black dot and the second black dot. In the example shown in FIG. 5B, the skip data indicates 7 pixels to be skipped. Accordingly, the present invention is characterized in that a relative address, that is, the skip amount, is used instead of an absolute address for specifying a pixel to be rewritten.

Figure 6A:
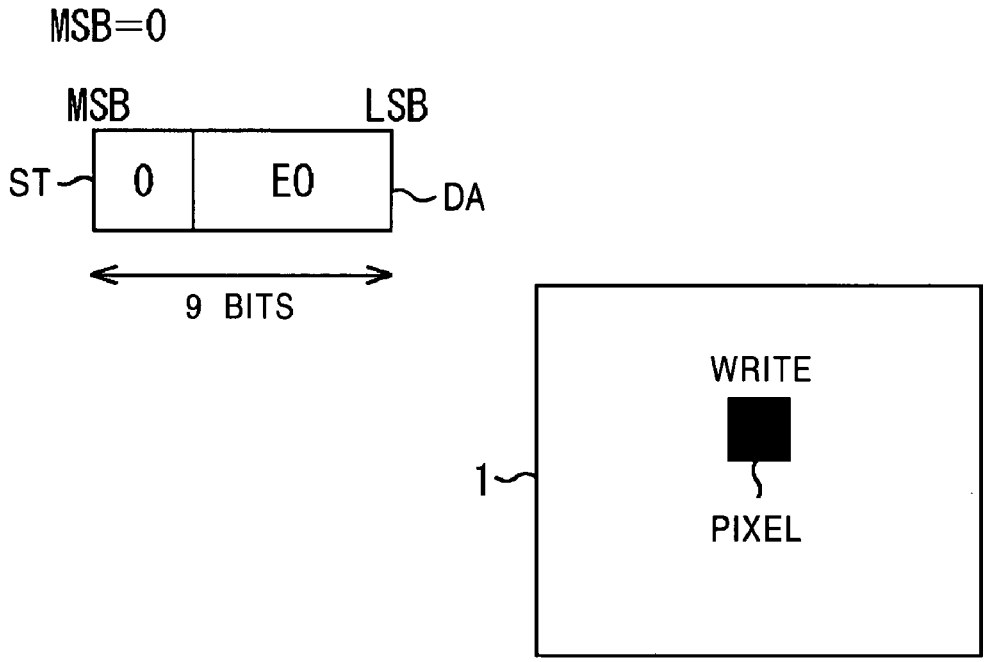
FIGS. 6A and 6B show the operation of the display device shown in FIG. 5A.
Figure 6B:
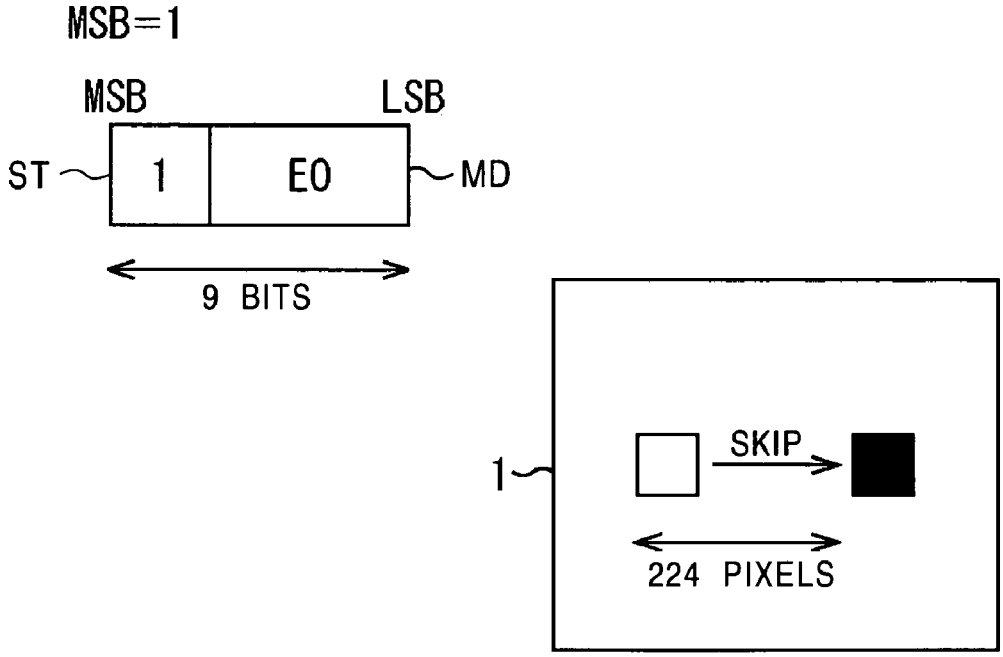

FIGS. 6A and 6B are schematic views showing specific configurations of the dot data and the skip data. As shown in FIG. 6A, the dot data has a parallel 9-bit structure, in which the MSB serves as a status part (flag) ST and the remaining 8 bits to the LSB form a data part DA. When the MSB corresponding to the flag ST is 0, that indicates rewrite is to be performed and that the parallel 9-bit data is dot data. The data part following the status part ST indicates the luminance of a corresponding pixel. Normally, the data part DA includes gray-scale data which is written into the corresponding pixel. In the embodiment, the data part DA is formed by 8 bits, and data of 256-level grayscale can be written thereto. In FIG. 6A, grayscale data is E0 in hexadecimal notation. E0 is 224 in decimal notation. Therefore, the pixel is rewritten so as to have a luminance corresponding to 224-level grayscale.

FIG. 6B shows the structure of the skip data. The skip data has the same format as that of the dot data shown in FIG. 6A and has a parallel 9-bit structure. When the MSB corresponding to its status part ST is 1, that indicates rewrite is not to be performed and that the parallel 9-bit data is not dot data but is skip data. The main data part MD of the skip data is formed by 8 bits and indicates a skip amount. Specifically, the number of pixels to be skipped can be specified up to 28=256. In FIG. 6B, the skip amount E0 is 224. Therefore, the skip data instructs to skip 224 pixels so as to address the next pixel. When the number of pixels to be skipped exceeds the maximum of 256, the desired skip amount can be substantially specified by continuously inputting skip data.

Normal video data is formed by 8 bits so as to represent 256-level grayscale. In the present invention, 1 bit is added thereto so as to form 9-bit video data. Low 8 bits are distributed to normal video data, and the MSB indexes need/no need of rewrite. If rewrite is to be performed, the low 8 bits are regarded as normal video data and are written into the displayed pixel. If rewrite is not to be performed, information of the number of pixels to be skipped is included in the low 8 bits. By using this method, up to 256 dots can be skipped. In this way, by adding a status bit, video data (dot data) and skip-amount data (skip data) can be mixed into a video signal in the same format. Accordingly, a new address bus need not be added, and thus partial rewrite can be efficiently performed for display. Also, by sequentially supplying skip data without a rewrite index, sequential skipping can be realized so as to perform scanning by skipping an arbitrary distance. In this way, partial rewrite can be realized so as to increase the rewrite speed of a display. At this time, partial rewrite can be efficiently performed by specifying a relative address by using the skipping method.

Figure 7:
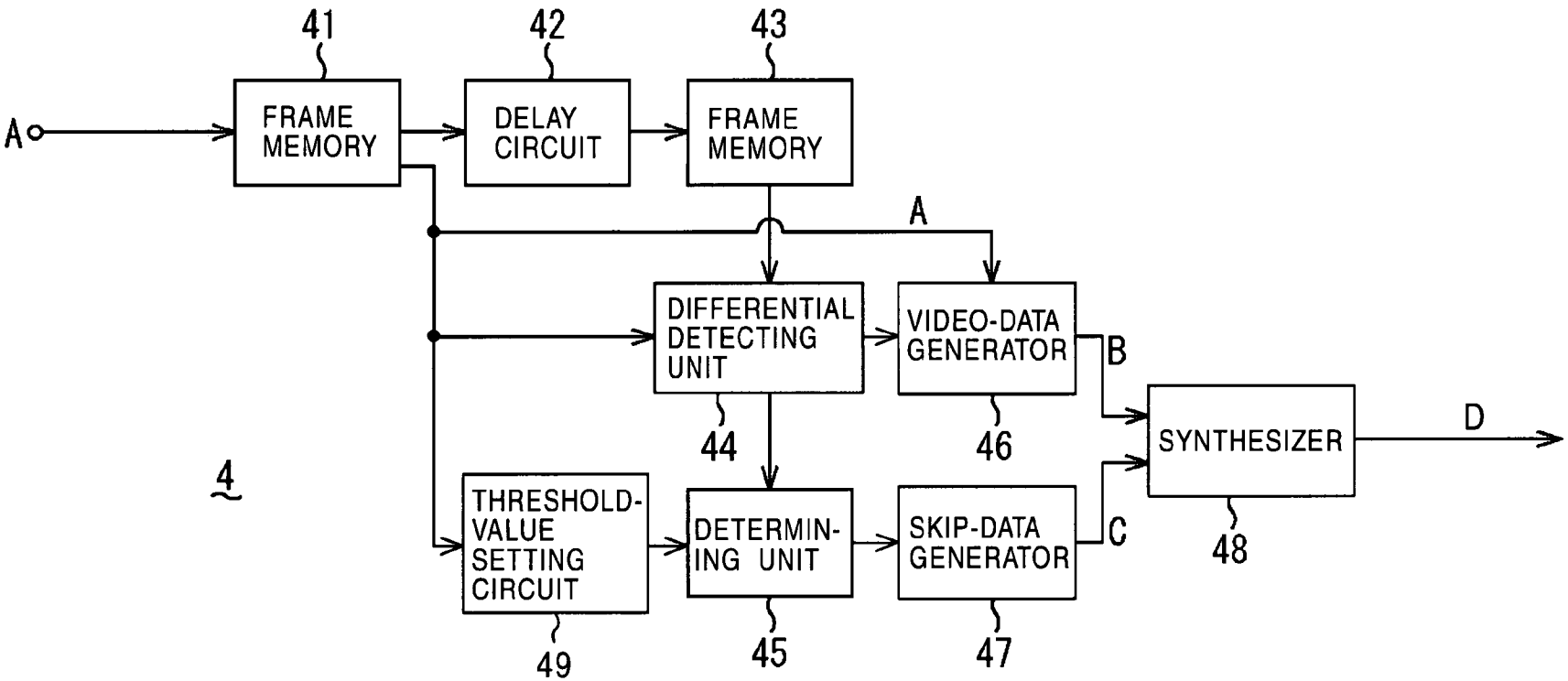
FIG. 7 is a block diagram of a signal processing unit.

FIG. 7 is a block diagram showing a signal processing unit 4 which generates a composite video signal including dot data and skip data. The signal processing unit 4 can be included in the active matrix display device, together with the pixel array unit 1, the scanning circuit 2, and the signal circuit 3 shown in FIG. 5A. Alternatively, the signal processing unit 4 may be formed separately, so that the composite video signal output therefrom may be supplied to the active matrix display device shown in FIG. 5A.

The signal processing unit 4 processes an original video signal A (for example, a digital video signal) so as to generate a composite video signal D including dot data and skip data. In order to perform this process, the signal processing unit 4 includes a frame memory 41, a delay circuit 42, a frame memory 43, a differential detecting unit 44, a determining unit 45, a video-data generator 46, a skip-data generator 47, and a synthesizer 48. The frame memory 41 stores the video data of a current frame. The frame memory 43 stores the video data of the previous frame which has been obtained by delaying the video data of the current frame. The differential detecting unit 44 detects the difference between the video data of the current frame and the video data of the previous frame in units of dots so as to output a differential value. The determining unit 45 determines whether or not the differential value output from the differential detecting unit 44 is equal to or exceeds a predetermined threshold value. The threshold value can be adequately set in the range of, for example, 0-level to 5-level. That is, the threshold value can be adequately changed in accordance with an image to be displayed. For example, as shown in FIG. 7, by providing a threshold-value setting circuit 49 and detecting the activity of video data in the frame memory 41, the flatness of the image can be detected, so that a high threshold level is set to a flat portion of the image. An example of the activity is the dynamic range of the video data. Of course, the threshold value can be set manually. When the determining unit 45 determines that the differential value is equal to or exceeds the predetermined threshold value, the video-data generator 46 generates output data B (dot data) based on status data indicating that the pixel is to be rewritten and video data A of the current frame. When the differential value output from the differential detecting unit 44 is less than the predetermined threshold value, the skip-data generator 47 generates output data C (skip data) based on status data indicating that rewrite of the pixel is not performed and skip-amount data defining the number of pixels to be skipped. The synthesizer 48 mixes the dot data B and the skip data C so as to generate a serial composite video signal D. The composite video signal D generated in this manner is supplied to the signal circuit.

Figures 8A, 8B, 8C, 8D:
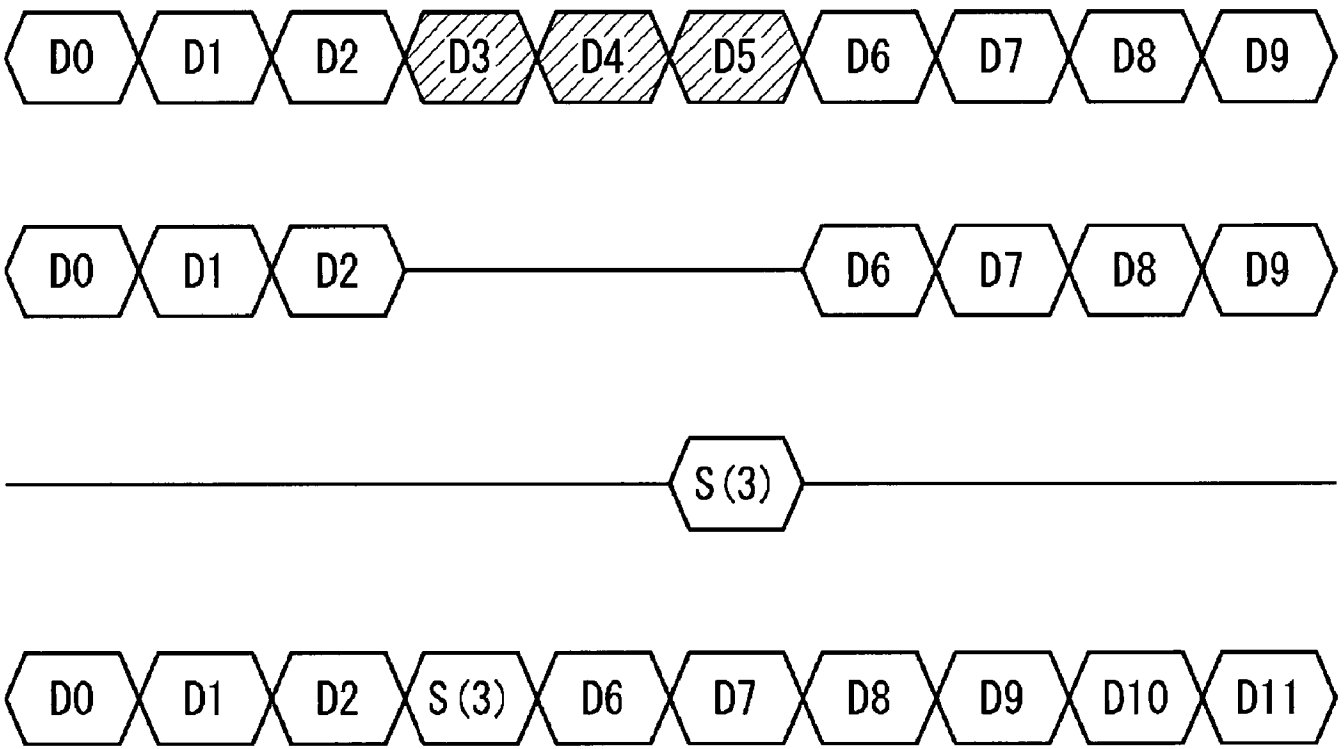
FIGS. 8A to 8D are timing charts of the operation of the signal processing unit shown in FIG. 7.

FIGS. 8A to 8D are timing charts for illustrating the operation of the signal processing unit 4 shown in FIG. 7. FIG. 8A shows an original video signal A. The original video signal A includes serial dot data D of 8 bits. Among the dot data D, dot data D0, D1, D2, D6, D7, D8, and D9 need to be rewritten, and hatched dot data D3, D4, and D5 need not be rewritten. FIG. 8B illustrates a dot-data sequence B output from the video-data generator 46. The video-data generator 46 adds a status bit to each of the dot data D0, D1, D2, D6, D7, D8, and D9, which need to be rewritten, and then outputs the dot data. At this time, the dot data D3, D4, and D5, which need not to be rewritten, are omitted. FIG. 8C shows the skip data C output from the skip-data generator 47. The skip-data generator 47 counts the dot data D3, D4, and D5, which need not be rewritten, and outputs skip data S. The main data part MD of the skip data S contains information of skip amount n=3, corresponding to three pieces of dot data D3, D4, and D5. FIG. 8D shows the composite video signal D output from the synthesizer 48. The synthesizer 48 includes a FIFO, and outputs a serial composite video signal D after arranging the dot data D and the skip data S in time series. In the example shown in FIG. 8D, the skip data S indicating three dots to be skipped is inserted between the dot data D2 and the dot data D6.

Figure 9:
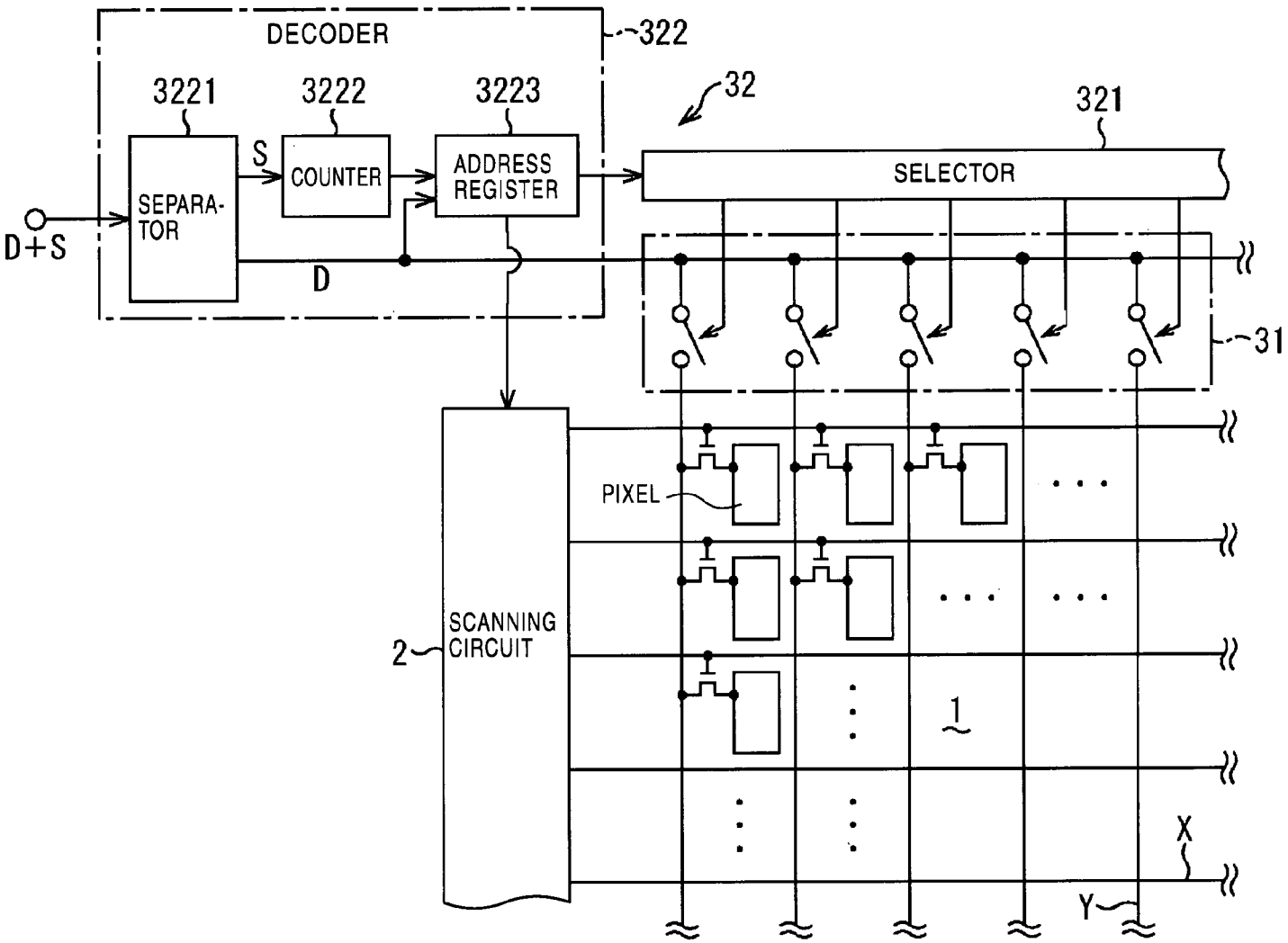
FIG. 9 is a circuit diagram showing an example of the display device shown in FIG. 5A.

FIG. 9 is a block diagram showing a specific configuration of the active matrix display device shown in FIG. 5A. In FIG. 9, parts corresponding to those in FIG. 5A are denoted by the same reference numerals for clarity. The display device according to the embodiment includes the pixel array unit 1 with M rows and N columns, the scanning circuit 2, and the signal circuit. As shown in FIG. 9, the signal circuit includes the sampling switch group 31 and the skip controller 32. The skip controller 32 includes a selector 321 and a decoder 322. The decoder 322 includes a separator 3221, a counter 3222, and an address register (ADR) 3223.

The separator 3221 separates serial video data into dot data D and skip data S by referring to the status part (flag) ST. The dot data D is supplied to the sampling switch group 31 and is written into a corresponding pixel. Also, the dot data D is supplied to the address register 3223, where the value thereof is sequentially incremented. The address register 3223 sequentially stores/updates the address of a pixel to be rewritten. On the other hand, the skip data S is input to the counter 3222, where a skip amount contained in the main data part MD is read out. The address register 3223 updates the value in the register according to the skip amount input from the counter 3222. The selector 321 controls open/close of the sampling switches in accordance with address information which is sequentially output from the address register 3223. At this time, only the sampling switches corresponding to the address specified by the address register 3223 are opened/closed, and thus skip scanning can be realized.

In the address register 3223, a maximum value is set to the number N of pixels included in one row. In other words, the address register 3223 counts the number of signal lines Y up to N. When the content of the address register 3223 exceeds the maximum value (overflown), a digit-increasing signal is transmitted to the scanning circuit 2, and the next row is selected.

Figure 10:
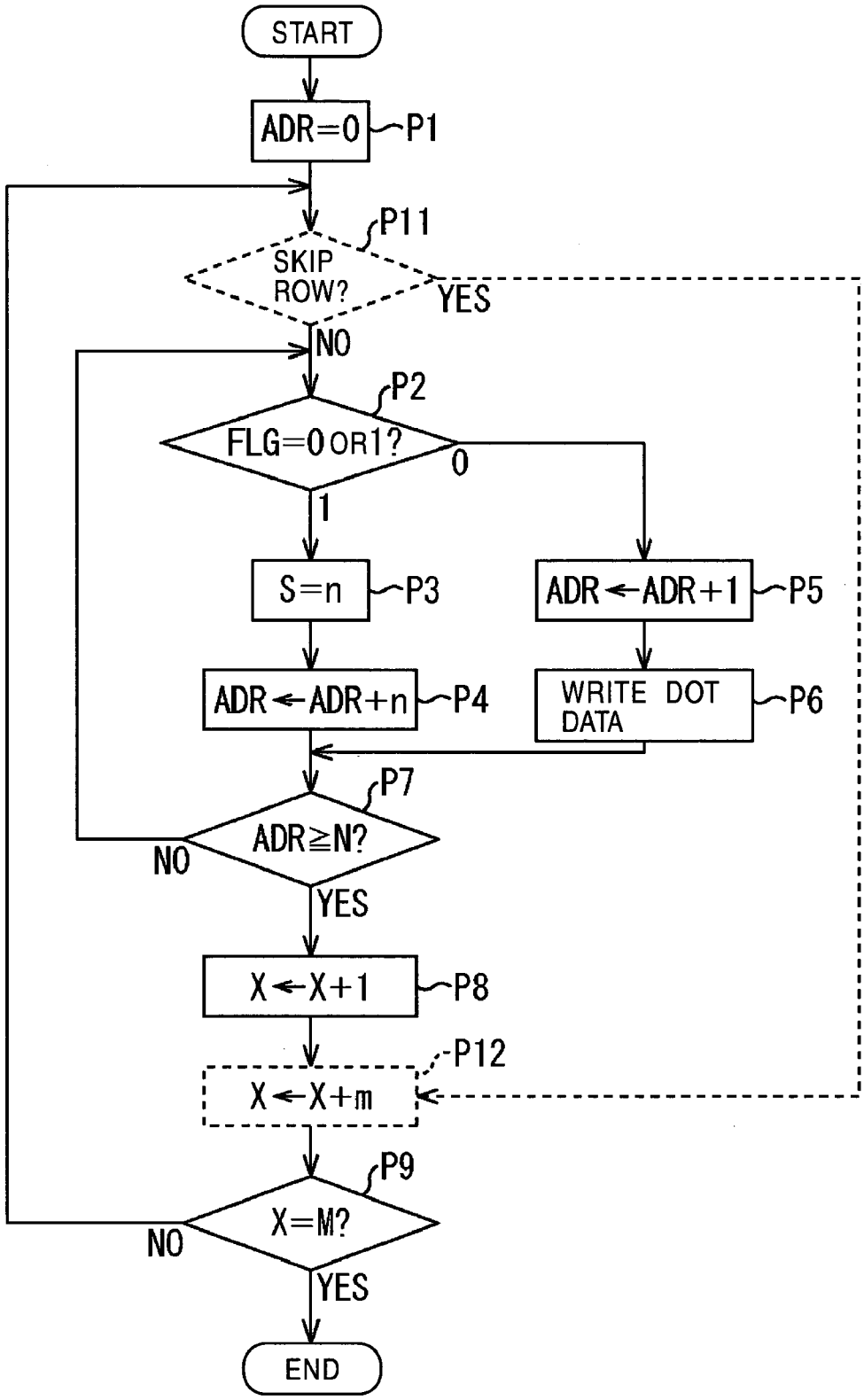
FIG. 10 is a flowchart of the operation of the display device shown in FIG. 9.

FIG. 10 is a flowchart showing skip scanning performed by the display device shown in FIG. 9. First, the address register (ADR) is initialized and is set to 0 in step P1. Then, in step P2, the flag (FLG) of input data is checked. When FLG=1, the input data is determined to be skip data. In this case, the process proceeds to step P3, where a skip amount n is obtained from the skip data S. Then, the process proceeds to step P4, where the content of the ADR is skip-incremented by the skip amount n. On the other hand, when FLG=0, the input data is determined to be dot data, and the process proceeds to step P5. In step P5, the content of the address register is incremented by 1. Then, the dot data is written into a corresponding pixel in step P6. Then, the process proceeds to step P7, where it is determined whether or not the content of the ADR is equal to or exceeds a maximum value N, which corresponds to the total number of the signal lines. If the determination result is negative, the process returns to step P2 and the above-described steps are performed again. On the other hand, if the determination result in step P7 is positive, the process proceeds to step P8, where the number of the gate line (row number) X to be selected is incremented by 1. Further, in step P9, it is determined whether or not the row number X has reached the total number M of the gate lines. If the determination result is negative, the process returns to step P2, and the above-described steps are performed again. On the other hand, if the determination result in step P9 is positive, writing of a differential video of one frame is completed.

If row skip data is included in a video signal, steps P11 and P12, which are indicated with broken lines, are added to the flowchart shown in FIG. 10. That is, it is determined whether or not row skip data is included in the video signal in step P11. If skip data is not included, the process proceeds to step P2. On the other hand, if skip data is included, the process jumps to step P12, where skip amount is incremented by the row skip amount m of the specified rows. Accordingly, pixels of m rows can be skipped at once.

The process shown in FIG. 10 can be performed by the hardware configuration shown in FIG. 9. Alternatively, the process can be performed by a software configuration equivalent to the hardware configuration. That is, the present invention includes a computer program for realizing the skip scanning shown in FIG. 10. Further, the present invention includes a recording medium containing the skip scanning program, such as a ROM, hard disk, or CD. Likewise, the signal processing shown in FIG. 7 can be computer-programmed.

In the above-described embodiment, liquid crystal cells are used as the pixels. However, the present invention is not limited to this. The present invention can be applied to any hold-type display as well as to a liquid crystal display (LCD). Such a hold-type display includes an organic EL element, a FED, and an electronic paper. The electronic paper is produced based on a thin display technique, as in liquid crystal. Literally, the electronic paper seems like ordinary paper, and consumes a little power in order to maintain the content of display. For example, in a technique of E Ink Corporation in the United States, minute capsules formed by wrapping a negatively-charged carbon (black) and a positively-charged titanium oxide (white) by a transparent resin are used. The capsules are applied to a film so as to form a front side. Then, electrodes are provided under the film. By applying a voltage to the electrodes, the titanium oxide and the carbon move vertically, so that a black/white pattern is formed. The titanium oxide is a white powder and the carbon is a black powder. Since characters and images are represented by using these powders, the appearance is like paper. The electronic paper does not have viewing-angle dependence, unlike in liquid crystal. Also, once rewrite is performed, the content of display is held even if the power is turned off. Accordingly, power consumption can be significantly reduced, for example, to 1/10 or less of that in a reflective liquid crystal display. As the electrode, a thin-film transistor (TFT) substrate, which is often used for liquid crystal displays, is used. The thickness of an electronic paper using a glass TFT substrate is about 0.9 mm. The thickness can be reduced if a thin plastic TFT substrate becomes available in the future. Prototypes of an electronic paper having a thickness of 0.3 mm have already been fabricated. If the substrate comprises a flexible material such as plastic, the substrate can be bended. Such a substrate can be adopted in mobile phones, PDAs, and electronic book readers.

As described above, according to the display device of the present invention, in which only a differential part is updated in each frame for displaying a moving picture, a simple circuit structure without an additional bus for inputting addresses can be obtained by adopting skip addressing instead of random addressing. Also, by adopting a relative address instead of an absolute address, partial rewrite can be relatively easily performed while preventing an address decoding circuit from being complicated. Further, in a self-addressing method according to the present invention, the skip amount does not vary significantly, compared to random addressing. Therefore, the pixel to be subsequently addressed is close to a current pixel, and thus propagation delay of a signal is less likely to occur. Accordingly, operational reliability is increased. Further, by converting pieces of dot data which need not be rewritten to skip data, the amount of data of each frame can be reduced, and the operation clock frequency can be decreased accordingly, which results in power saving. In addition, by lowering the operation clock frequency, the margin of a maximum operation frequency is increased. Thus, a refresh rate can be increased and the quality of an image can be enhanced.

What is claimed is:

1. An active matrix display device comprising:

a panel on which pixels are arranged in a matrix pattern;

a scanning circuit for sequentially selecting pixels on the panel in units of rows; and a signal circuit which sequentially receives pieces of video data, each including a status part indicating need/no need for rewriting a pixel and a main data part including video data to be written into the pixel, and which writes corresponding video data into pixels which have been determined to be rewritten based on the status part among the selected pixels, while skipping the other pixels, wherein the signal circuit receives a video signal including dot data and skip data, both data having the same format including a status part and a data part, the signal circuit determines whether the video signal includes the dot data or the skip data, and when it is determined that the video signal includes the skip data, the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

2. The active matrix display device according to claim 1, wherein, while the status part of the video data indicates that rewrite is not to be performed, the number of pixels to be skipped, instead of the video data, is written into the main data part.

3. An active matrix display device comprising:

a pixel array unit including pixels which are arranged in a matrix pattern;

a scanning circuit for sequentially selecting pixels in units of rows; and a signal circuit which receives a video signal including serial dot data corresponding to each pixel and which writes the dot data into the selected pixels, wherein the signal circuit receives a video signal which includes dot data corresponding to pixels to be rewritten but does not include dot data corresponding to pixels not to be rewritten and which includes skip data defining a skip amount, and the signal circuit sequentially processes the dot data and the skip data so as to write corresponding dot data into pixels to be rewritten while skipping pixels not to be rewritten in accordance with the skip amount, wherein the signal circuit receives a video signal including dot data and skip data, both data having the same format including a status part and a data part, the signal circuit determines whether the video signal includes the dot data or the skip data, and when it is determined that the video signal includes the skip data, the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

4. The active matrix display device according to claim 3, wherein, when the number of pixels to be skipped exceeds a maximum number that can be defined by a piece of skip data, the signal circuit processes skip data which is continuously input until the number reaches the target skip amount so as to skip pixels.

5. The active matrix display device according to claim 3, wherein the signal circuit receives a video signal including row skip data which defines a skip amount in units of rows, and performs writing of dot data while skipping pixels in units of rows based on the row skip data.

6. An active matrix display device comprising:

a pixel array unit including pixels which are arranged in a matrix pattern;

a scanning circuit for sequentially selecting pixels in units of rows; and a signal circuit which receives a video signal including serial dot data corresponding to each pixel and which writes the dot data into the selected pixels, wherein the signal circuit receives a video signal which includes dot data corresponding to pixels to be rewritten but does not include dot data corresponding to pixels not to be rewritten and which includes skip data defining a skip amount, and the signal circuit sequentially processes the dot data and the skip data so as to write corresponding dot data into pixels to be rewritten while skipping pixels not to be rewritten in accordance with the skip amount, wherein the signal circuit mixes, at a predetermined ratio, frames to which a partial rewrite operation for partially rewriting the pixels arranged in a matrix pattern is performed by processing the video signal including the dot data and the skip data and frames to which an entire rewrite operation for entirely rewriting the pixels arranged in a matrix pattern is performed by processing the video signal including the dot data.

7. An active matrix display device comprising:

a pixel array unit including pixels which are arranged in a matrix pattern;

a scanning circuit for sequentially selecting pixels in units of rows; and a signal circuit which receives a video signal including serial dot data corresponding to each pixel and which writes the dot data into the selected pixels, wherein the signal circuit receives a video signal which includes dot data corresponding to pixels to be rewritten but does not include dot data corresponding to pixels not to be rewritten and which includes skip data defining a skip amount, and the signal circuit sequentially processes the dot data and the skip data so as to write corresponding dot data into pixels to be rewritten while skipping pixels not to be rewritten in accordance with the skip amount, further comprising a signal processing circuit for supplying the video signal including the dot data and the skip data to the signal circuit, the signal processing circuit comprising:

differential detecting means for detecting and outputting a differential value between the video data of a current frame corresponding to a target pixel and the video data of the previous frame;

determining means for determining whether or not the differential value output from the differential detecting means is equal to or exceeds a predetermined threshold value; and output-data generating means which generates dot data based on status data indicating that a pixel is to be rewritten and the video data of the current frame when the determining means determines that the differential value is equal to or exceeds the predetermined threshold value and which generates skip data based on status data indicating that a pixel is not to be rewritten and a skip amount defining the number of pixels to be skipped when the differential value is less than the predetermined threshold value.

8. The active matrix display device according to claim 7, further comprising threshold-value setting means for setting the threshold value.

9. The active matrix display device according to claim 8, wherein the threshold-value setting means detects the dynamic range of the video signal so as to set the threshold value based on the detected dynamic range.

10. A signal processing device comprising:

differential detecting means for detecting and outputting a differential value between the video data of a current frame corresponding to a target pixel and the video data of the previous frame;

determining means for determining whether or not the differential value output from the differential detecting means is equal to or exceeds a predetermined threshold value; and output-data generating means which generates output dor data based on status data indicating that a pixel is to be rewritten and the video data of the current frame when the determining means determines that the differential value is equal to or exceeds the predetermined threshold value and which generates output skip data based on status data indicating that a pixel is not to be rewritten and a skip amount defining the number of pixels to be skipped when the differential value is less than the predetermined threshold value.

11. The signal processing device according to claim 10, further comprising threshold-value setting means for setting the threshold value.

12. The signal processing device according to claim 11, wherein the threshold-value setting means detects the dynamic range of the video signal so as to set the threshold value based on the detected dynamic range.

13. A method of driving an active matrix display device comprising a panel on which pixels are arranged in a matrix pattern, the method comprising:

a step of sequentially selecting pixels on the panel in units of rows;

a step of sequentially receiving pieces of video data, each including a status part indicating need/no need for rewriting a pixel and a main data part including video data to be written into the pixel; and a step of writing corresponding video data into pixels which have been determined to be rewritten based on the status part among the selected pixels, while skipping the other pixels, wherein a signal circuit receives a video signal including dot data and skip data, both data having the same format including a status part and a data part, the signal circuit determines whether the video signal includes the dot data or the skip data, and when it is determined that the video signal includes the skip data, the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

14. A method of driving an active matrix display device comprising a pixel array unit including pixels which are arranged in a matrix pattern; a scanning circuit for sequentially selecting pixels in units of rows; and a signal circuit which receives a video signal including serial dot data corresponding to each pixel and which writes the dot data into the selected pixels, the method comprising:

a step of receiving a video signal which includes dot data corresponding to pixels to be rewritten but does not include dot data corresponding to pixels not to be rewritten and which includes skip data defining a skip amount; and a step of sequentially processing the dot data and the skip data so as to write corresponding dot data into pixels to be rewritten while skipping pixels not to be rewritten in accordance with the skip amounts wherein the signal circuit receives a video signal including dot data and skip data, both data having the same format including a status part and a data part, the signal circuit determines whether the video signal includes the dot data or the skip data, and when it is determined that the video signal includes the skip data, the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

15. A method of processing a signal, the method comprising:

a differential detecting step for detecting and outputting a differential value between the video data of a current frame corresponding to a target pixel and the video data of the previous frame;

a determining step for determining whether or not the differential value output in the differential detecting step is equal to or exceeds a predetermined threshold value; and an output-data generating step for generating output dot data based on status data indicating that a pixel is to be rewritten and the video data of the current frame when the differential value is determined to be equal to or exceed the predetermined threshold value in the determining step and for generating output skip data based on status data indicating that a pixel is not to be rewritten and a skip amount defining the number of pixels to be skipped when the differential value is less than the predetermined threshold value.

16. A computer program executed for driving an active matrix display device comprising a panel on which pixels are arranged in a matrix pattern, the computer program comprising:

a step of sequentially selecting pixels on the panel in units of rows;

a step of sequentially receiving pieces of video data, each including a status part indicating need/no need for rewriting a pixel and a main data part including video data to be written into the pixel; and a step of writing corresponding video data into pixels which have been determined to be rewritten based on the status part among the selected pixels, while skipping the other pixels wherein a signal circuit receives a video signal including dot data and skip data, both data having the same format including a status part and a data part.

the signal circuit determines whether the video signal includes the clot data or the skip data, and when it is determined that the video signal includes the skip data, the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

17. A computer program executed for driving an active matrix display device comprising a pixel array unit including pixels which are arranged in a matrix pattern; a scanning circuit for sequentially selecting pixels in units of rows; and a signal circuit which receives a video signal including serial dot data corresponding to each pixel and which writes the dot data into the selected pixels, the computer program comprising:

a step of receiving a video signal which includes dot data corresponding to pixels to be rewritten but does not include dot data corresponding to pixels not to be rewritten and which includes skip data defining a skip amount; and a step of sequentially processing the dot data and the skip data so as to write corresponding dot data-into pixels to be rewritten while skipping pixels not to be rewritten in accordance with the skip amount, wherein the signal circuit receives a video signal including dot data and skip data, both data having the same format including a status part and a data part, the signal circuit determines whether the video signal includes the dot data or the skip data, and when it is determined that the video signal includes the skip data, the signal circuit obtains a skip amount indicating the number of pixels to be skipped from the data part of the skip data, and when it is determined that the video signal includes the dot data the signal circuit extracts luminance information of a pixel to be rewritten from the data part of the dot data.

18. A signal processing program executed by a computer, the program comprising:

a differential detecting step for detecting and outputting a differential value between the video data of a current frame corresponding to a target pixel and the video data of the previous frame;

a determining step for determining whether or not the differential value output in the differential detecting step is equal to or exceeds a predetermined threshold value; and an output-data generating step for generating output data based on status data indicating that a pixel is to be rewritten and the video data of the current frame when the differential value is determined to be equal to or exceed the predetermined threshold value in the determining step and for generating output skip data based on status data indicating that a pixel is not to be rewritten and a skip amount defining the number of pixels to be skipped when the differential value is less than the predetermined threshold value.

19. A storage medium for storing a computer program executed for driving an active matrix display device comprising a panel on which pixels are arranged in a matrix pattern, the computer program comprising:

a step of sequentially selecting pixels on the panel in units of rows;

a step of sequentially receiving pieces of video data, each including a status part indicating need/no need for rewriting a pixel and a main data part including video data to be written into the pixel; and a step of writing corresponding video data into pixels which have been determined to be rewritten based on the status part among the selected pixels, while skipping the other pixels wherein a signal circuit receives a video signal including dot data and skip data, both data having the same format including a status part and a data part.

the signal circuit determines whether the video signal includes the dot data or the skip data, and when it is determined that the video signal includes the skip data the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

20. A storage medium for storing a computer program executed for driving an active matrix display device comprising a pixel array unit including pixels which are arranged in a matrix pattern a scanning circuit for sequentially selecting pixels in units of rows; and a signal circuit which receives a video signal including serial dot data corresponding to each pixel and which writes the dot data into the selected pixels, the computer program comprising:

a step of receiving a video signal which includes dot data corresponding to pixels to be rewritten but does not include dot data corresponding to pixels not to be rewritten and which includes skip data defining a skip amount; and a step of sequentially processing the dot data and the skip data so as to write corresponding dot data into pixels to be rewritten while skipping pixels not to be rewritten in accordance with the skip amounts wherein the signal circuit receives a video signal including dot data and skip data, both data having the same format including a status part and a data part, the signal circuit determines whether the video signal includes the dot data or the skip data, and when it is determined that the video signal includes the skip data the signal circuit obtains a skip amount indicating the number of pixels to be skipped from the data part of the skip data, and when it is determined that the video signal includes the dot data, the signal circuit extracts luminance information of a pixel to be rewritten from the data part of the dot data.

21. A storage medium for storing a signal processing program executed by a computer, the program comprising:

a differential detecting step for detecting and outputting a differential value between the video data of a current frame corresponding to a target pixel and the video data of the previous frame;

a determining step for determining whether or not the differential value output in the differential detecting step is equal to or exceeds a predetermined threshold value; and an output-data generating step for generating output dot data based on status data indicating that a pixel is to be rewritten and the video data of the current frame when the differential value is determined to be equal to or exceed the predetermined threshold value in the determining step and for generating output skip data based on status data indicating that a pixel is not to be rewritten and a skip amount defining the number of pixels to be skipped when the differential value is less than the predetermined threshold value.

* * * * *